US010094228B2

(12) United States Patent
Jendrix et al.

(10) Patent No.: US 10,094,228 B2
(45) Date of Patent: Oct. 9, 2018

(54) TURBINE DOVETAIL SLOT HEAT SHIELD

(71) Applicant: General Electric Company, Schenectady, NY (US)

(72) Inventors: Richard William Jendrix, Liberty Township, OH (US); Christopher Thomas Schuppe, West Chester, OH (US); Christopher John Van Derven, Cincinnati, OH (US); Samuel Joseph Stoughton, West Chester, OH (US); Charles Thomas McMillan, Liberty Township, OH (US); John David Bibler, Kings Mills, OH (US)

(73) Assignee: General Electric Company, Schenectady, NY (US)

( * ) Notice: Subject to any disclaimer, the term of this patent is extended or adjusted under 35 U.S.C. 154(b) by 691 days.

(21) Appl. No.: 14/702,097

(22) Filed: May 1, 2015

(65) Prior Publication Data

US 2016/0319681 A1 Nov. 3, 2016

(51) Int. Cl.

| | |
|---|---|
| ***F01D 11/00*** | (2006.01) |
| ***F01D 5/30*** | (2006.01) |
| ***F01D 11/02*** | (2006.01) |

(52) U.S. Cl.

CPC ..... *F01D 5/3007* (2013.01); *F01D 11/02* (2013.01)

(58) Field of Classification Search

CPC ..... F01D 11/02; F01D 5/3007; F01D 5/085; F01D 5/087; F01D 5/088

See application file for complete search history.

(56) References Cited

U.S. PATENT DOCUMENTS 3,356,340 A 12/1967 Bobo
4,505,640 A * 3/1985 Hsing ..... F01D 5/187 416/219 R (Continued)

FOREIGN PATENT DOCUMENTS

CN 202578804 12/2012
CN 103228870 A 7/2013

(Continued)

OTHER PUBLICATIONS

A European Search Report and opinion issued in connection with corresponding EP Application No. 16167746.3 dated Oct. 17, 2016.

(Continued)

*Primary Examiner* — Woody Lee, Jr.
(74) *Attorney, Agent, or Firm* — General Electric Company; William Scott Andes

(57) ABSTRACT

Gas turbine engine turbine blade assembly includes a hollow airfoil joined to blade root, dovetail slot heat shield bonded or attached to a bottom surface of the root, and a shield outlet from heat shield open to inlet apertures extending radially through a radially inner root end of the root. Heat shield may have body with legs extending upwardly from heat shield bottom, slanted open upstream end, and free ends of the legs longer than the heat shield bottom. Flanges may be located along free ends and bonded to bottom surface. Body, heat shield bottom and/or the legs may be rounded. Disk includes a plurality of dovetail slots formed in a rim, complimentary plurality of turbine blades removably retained in dovetail slots by the roots, slot bottoms of the dovetail slots extending circumferentially between disk posts in rim. Heat shield bottoms may be radially spaced apart the slot bottoms.

11 Claims, 6 Drawing Sheets

(56) References Cited

U.S. PATENT DOCUMENTS 4,626,169 A * 12/1986 Hsing ..... F01D 5/187 416/220 R
4,820,123 A 4/1989 Hall
5,104,290 A * 4/1992 Catlow ..... F01D 5/3007 415/115
5,339,619 A 8/1994 Antonellis
5,941,687 A * 8/1999 Tubbs ..... F01D 5/081 416/96 R
6,059,529 A * 5/2000 Schiavo ..... F01D 5/081 416/95
6,254,345 B1 * 7/2001 Harris ..... F01D 5/18 416/189
6,491,496 B2 12/2002 Starkweather
6,786,696 B2 9/2004 Herman et al.
8,047,790 B1 * 11/2011 Liang ..... F01D 5/187 416/90 R
8,307,662 B2 11/2012 Turco
9,051,838 B2 * 6/2015 Wardle ..... F01D 5/081
9,145,780 B2 * 9/2015 Propheter-Hinckley ..... F01D 5/186
9,181,805 B2 * 11/2015 Coutandin ..... F01D 5/081
2002/0122716 A1 9/2002 Beacock et al.
2004/0115054 A1 * 6/2004 Balland ..... F01D 5/081 416/97 R
2005/0207892 A1 * 9/2005 Kanebako ..... F01D 5/081 416/219 R
2012/0134785 A1 5/2012 Khanin et al.

FOREIGN PATENT DOCUMENTS

DE 102005008509 A1 9/2005
EP 1251243 A1 10/2002
GB 742477 A 12/1955
GB 2319308 A 5/1998
WO 9947792 A1 9/1999

OTHER PUBLICATIONS

First Office Action and Search issued in connection with corresponding CN Application No. 201610549741.4 dated Apr. 28, 2017.

* cited by examiner

TURBINE DOVETAIL SLOT HEAT SHIELD

BACKGROUND OF THE INVENTION

Technical Field

The present invention relates generally to gas turbine engine turbine blade cooling and, more specifically, cooled turbine blades and slots for mounting the blades.

Background Information

Turbine blades in gas turbine engine turbines and, particularly, high pressure turbine blades are often cooled by a portion of pressurized air from a compressor of the engine. Each turbine stage includes a row of turbine rotor blades extending radially outwardly from a supporting rotor disk with the radially outer tips of the blades being mounted inside a surrounding turbine shroud. Typically, turbine rotor blades of at least the first turbine stage are cooled by the bled portion of the pressurized air from the compressor. The blades include roots slid into and secured by axial slots in a turbine disk.

The blades are typically cooled using a portion of high pressure compressor discharge air bled (also known as compressor discharge pressure or CDP air) from the last stage of the compressor. The air is suitably channeled through internal cooling channels inside the hollow blades and discharged through the blades in various rows of film cooling holes from the leading edge and aft therefrom, and also typically including a row of trailing edge outlet holes or slots on the airfoil pressure side.

Blade cooling air is gathered and transferred from static portions of the engine to the rotating disk supporting the blades. The cooling air passes through the slot and into the blade root from where it is distributed through a cooling circuit having cooling passages in an airfoil of the blade.

The typical turbofan aircraft engine initially operates at a low power, idle mode and then undergoes an increase in power for takeoff and climb operation. Upon reaching cruise at the desired altitude of flight, the engine is operated at lower or intermediate power setting. The engine is also operated at lower power as the aircraft descends from altitude and lands on the runway, following which thrust reverse operation is typically employed with the engine again operated at high power. In the various transient modes of operation of the engine where the power increases or decreases, the turbine blades heat up and cool down respectively.

A slot bottom of the disk is exposed to blade cooling air during engine operation. The cooling air increases the thermal response of the slot bottom creating a large thermal gradient between the slot bottom and bore of the disk. This gradient creates large thermal stresses in both the acceleration and deceleration of the engine. These large thermal stresses reduces the low cycle fatigue life of the disk.

Accordingly, it is desired to provide a gas turbine engine having turbine blade cooling with a design which reduces a thermal gradient in a bottom of a root mounting slot. It is further desired to reduce large thermal stresses in the bottom of the root mounting slot caused by the thermal gradient. It is also desired to increase the low cycle fatigue life of the disk by reducing these thermal stresses.

BRIEF DESCRIPTION OF THE INVENTION

A gas turbine engine turbine blade assembly includes a hollow airfoil integrally joined to a blade root, a dovetail slot heat shield attached to a bottom surface of the root, and a shield outlet from the dovetail slot heat shield open to at least one inlet aperture extending radially through a radially inner root end of the root. The heat shield may be bonded to the bottom surface.

The heat shield may include a body with a heat shield bottom and sides or legs extending upwardly or radially outwardly from the heat shield bottom. The heat shield may have a slanted open forward or upstream end and free ends of the legs may be longer than the heat shield bottom.

An axially extending straight flange may be located along a free end of each of the legs and the flanges may be bonded to the bottom surface. The heat shield may have a slanted open forward or upstream end of the heat shield and the flanges and the free ends of the legs may be longer than the heat shield bottom. The body may be rounded. The heat shield bottom and/or the legs may be rounded.

A gas turbine engine turbine disk assembly may include a disk including a web extending radially outwardly from a hub to a rim; a plurality of dovetail slots in the rim; a complimentary plurality of turbine blades removably retained in the plurality of dovetail slots; slot bottoms of the dovetail slots and the dovetail slots extending circumferentially between disk posts in the rim on the disk assembly, and each of the turbine blades including a hollow airfoil integrally joined to a blade root, a dovetail slot heat shield attached to a bottom surface of the root, and a shield outlet from the dovetail slot heat shield open to at least one inlet aperture extending radially through a radially inner root end of the root.

The gas turbine engine turbine disk assembly may include a clearance between the heat shield bottoms of the heat shields and respective ones of the slot bottoms. The heat shield bottoms may be radially spaced apart from respective ones of the slot bottoms and the heat shields may be bonded to the bottom surfaces.

DETAILED DESCRIPTION OF THE INVENTION

Figure 1:
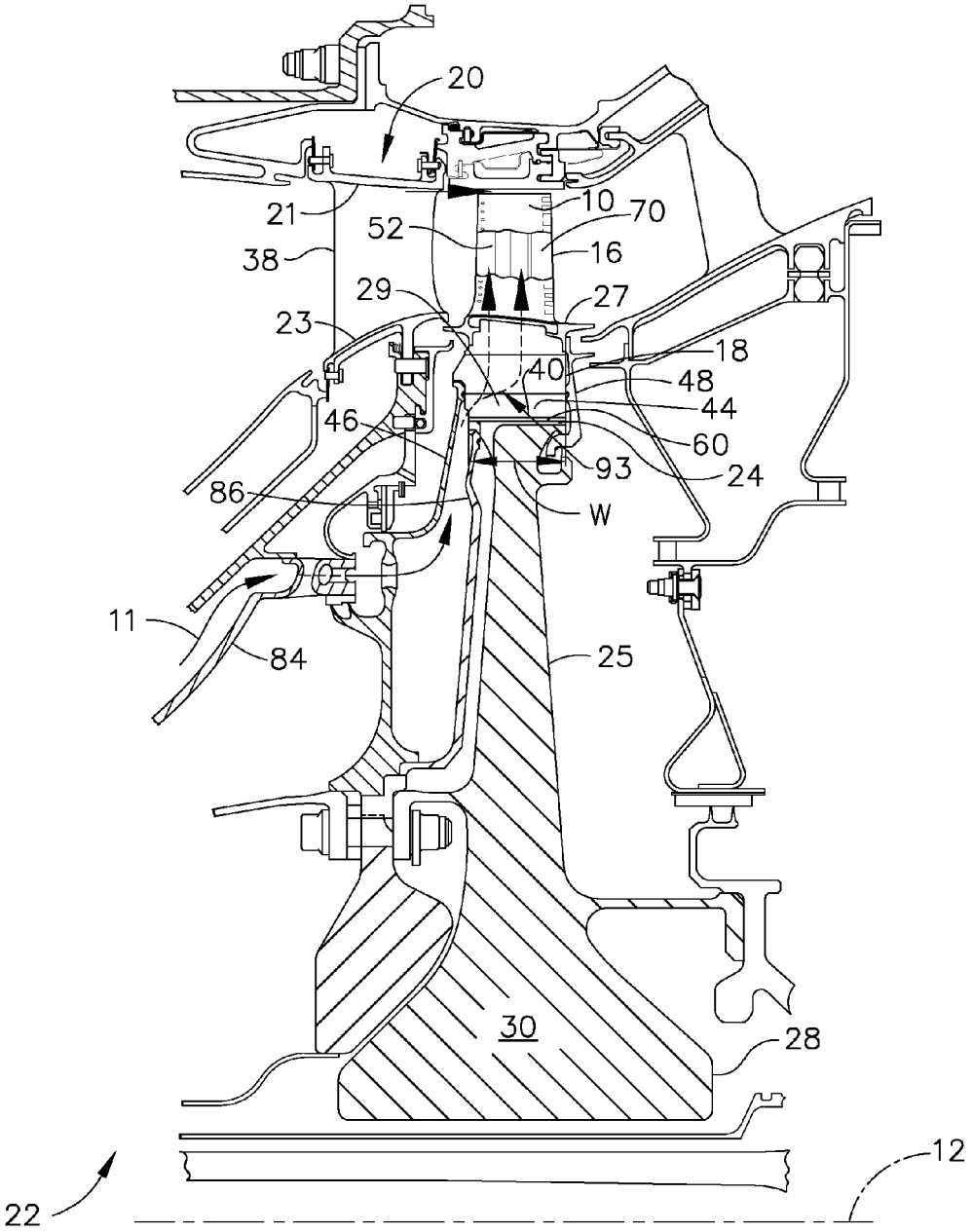
FIG. 1 is an axial sectional schematic view illustration of a high pressure turbine blade with a turbine dovetail slot heat shield mounted on a turbine blade root and disposed in a slot in a turbine disk.

Illustrated schematically in FIG. 1 is an exemplary gas turbine engine high pressure turbine (HPT) section 22 circumscribed about a longitudinal or axial centerline axis 12. The high pressure turbine section 22 includes a turbine nozzle 20 having a circumferential row of stator vanes 38 suitably mounted between outer and inner bands 21, 23. Following the turbine nozzle 20 is a single row of exemplary turbine blades 10 removably mounted to the perimeter or rim 24 of a first stage HP rotor disk 30. The rotor disk 30 includes a web 25 extending radially outwardly from a hub 28 to the rim 24.

Figure 2:
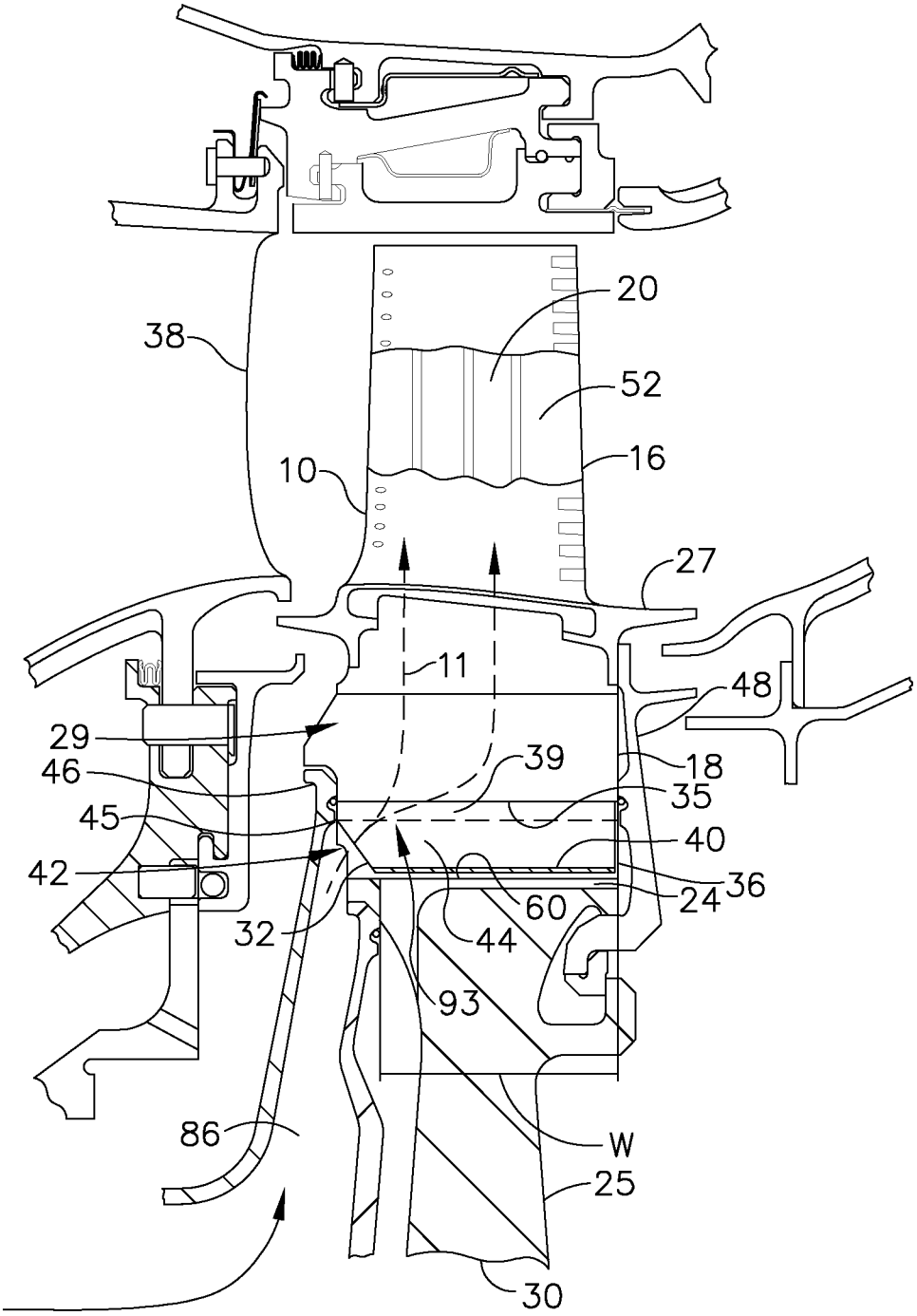
FIG. 2 is an enlarged axial sectional schematic view illustration of cooling air flowing through the turbine blade and root illustrated in FIG. 1.
Figure 3:
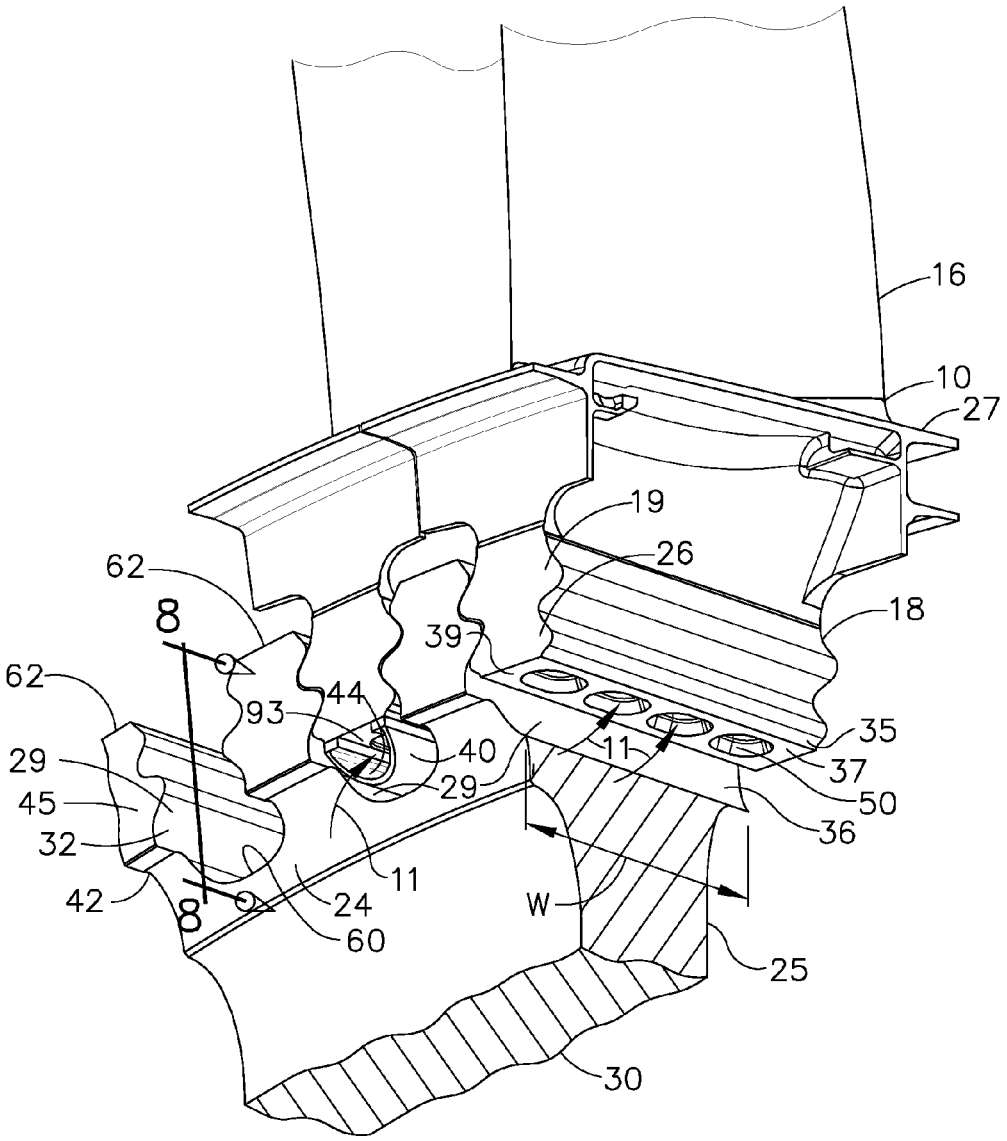
FIG. 3 is a perspective view illustration of the turbine blade root and the turbine dovetail slot heat shield illustrated in FIG. 2.
Figure 4:
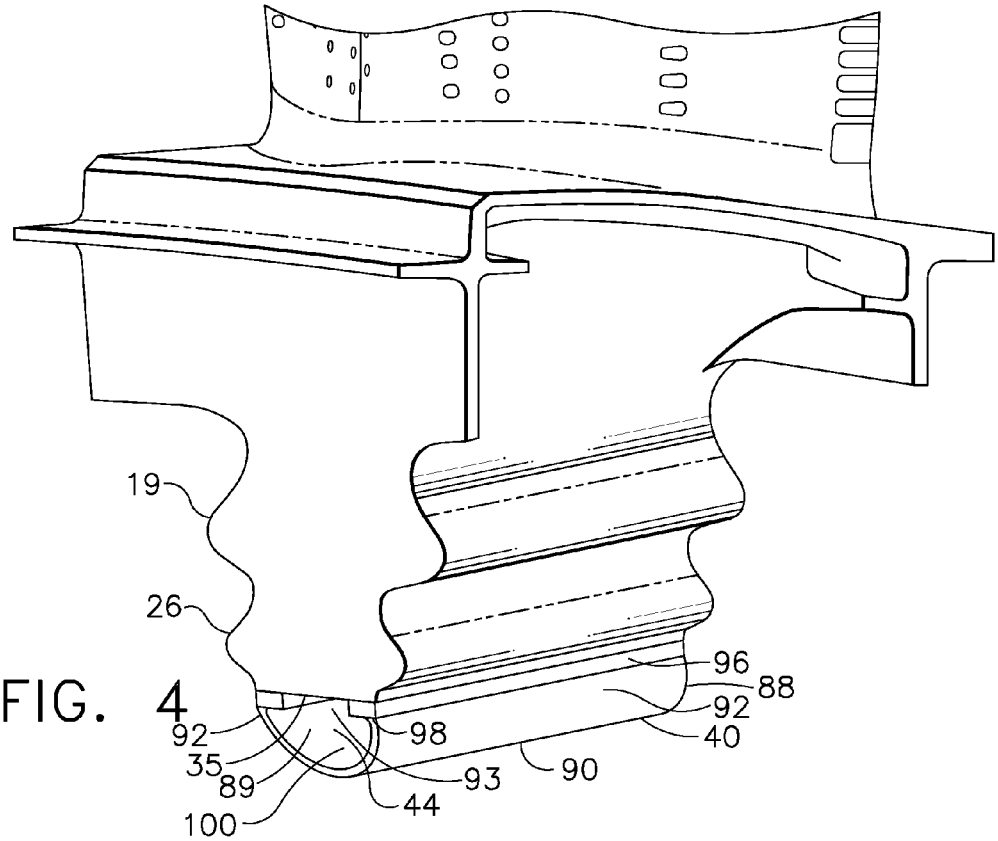
FIG. 4 is a perspective view illustration of the turbine dovetail slot heat shield mounted to turbine blade root illustrated in FIG. 2.

Referring to FIGS. 1-3, each of the turbine blades 10 includes a hollow airfoil 16 integrally joined to an axial-entry dovetail root 18 at a platform 27 of the turbine blade 10. As illustrated in FIGS. 2 and 4, the preferred embodiment of the blade dovetail root 18 includes an upper pair of laterally or circumferentially opposite lobes or tangs 19 and a lower pair of lobes or tangs 26. The tangs are configured in a typical fir tree configuration for supporting and radially retaining the individual blade in a complementary axial dovetail slot 29 formed in the rim 24 of the rotor disk 30 as illustrated in FIGS. 1-4.

Referring to FIG. 3, a plurality of inlet apertures 50 extend radially through a radially inner root end 35 of the dovetail root 18. The inlet apertures 50 allow turbine blade cooling air 11 to flow from the dovetail slot 29 into a cooling air circuit 52 in the airfoil 16 as illustrated in FIGS. 1-2. Referring to FIGS. 1-2, an annular flow inducer 84 injects the turbine blade cooling air 11 into the rotating rotor disk 30 as is well known in the field. The flow inducer 84 typically includes a row of vanes 86 which tangentially accelerates, meters, and/or pressurizes the cooling air 11 and injects the cooling air 11 into the dovetail slot 29 of the rotating first stage rotor disk 30.

The cooling air 11 flows into the dovetail slot 29, through the root end 35, and then radially outwardly through cooling channels 70 in the cooling air circuit 52 in the airfoil 16. The cooling air 11 is then discharged through rows of outlet holes in the pressure and suction sides of the blade airfoil in a conventional manner. Further referring to FIG. 3, a slot bottom 60 and the dovetail slot 29 extend circumferentially between disk posts 62 in the rim 24 on the rotor disk 30. The dovetail slot 29 extends axially between a dovetail slot inlet 32 and a dovetail slot aft end 36. The dovetail roots 18 are axially retained in the dovetail slots 29 by forward and aft retaining plates 46, 48 mounted to the rotor disk 30 as illustrated in FIGS. 1 and 2.

Referring to FIGS. 1-3, a dovetail slot cooling air chamber or manifold 44 is radially located between the root end 35 of the dovetail root 18 and the slot bottom 60 of the dovetail slot 29 in the rim 24 on the rotor disk 30. The root end 35 of the dovetail root 18 demarks a top 39 or radially outer boundary of the dovetail slot cooling air chamber or manifold 44. The root end 35 of the dovetail root 18 is longer than an axially extending width W of the rim 24 along the dovetail slot 29 and axially longer than the slot bottom 60. A notch or cutback 42 in an axially forward end 45 of the rim 24 accommodates the root end 35 of the dovetail root 18 being axially longer than the slot bottom 60.

Referring to FIGS. 1-3, a dovetail slot heat shield 40 is attached to a bottom surface 37 of the dovetail root 18 and disposed within the dovetail slot cooling air chamber or manifold 44. The heat shield 40 may be bonded to the bottom surface 37 such as by brazing or welding. The heat shield 40 is designed to shield a slot bottom 60 from the cooling air 11. The heat shield 40 is designed to reduce the ability of the cooling air 11 to substantially impact the thermal response of the slot bottom 60 and to reduce a rim to bore thermal gradient as well as the thermal stresses.

Figure 5:
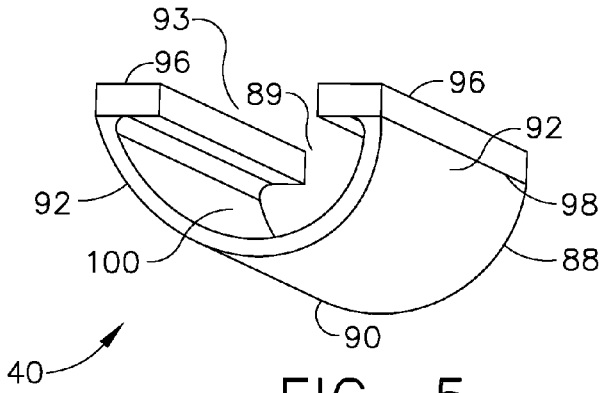
FIG. 5 is a perspective view illustration of the turbine dovetail slot heat shield illustrated in FIG. 4.
Figure 6:
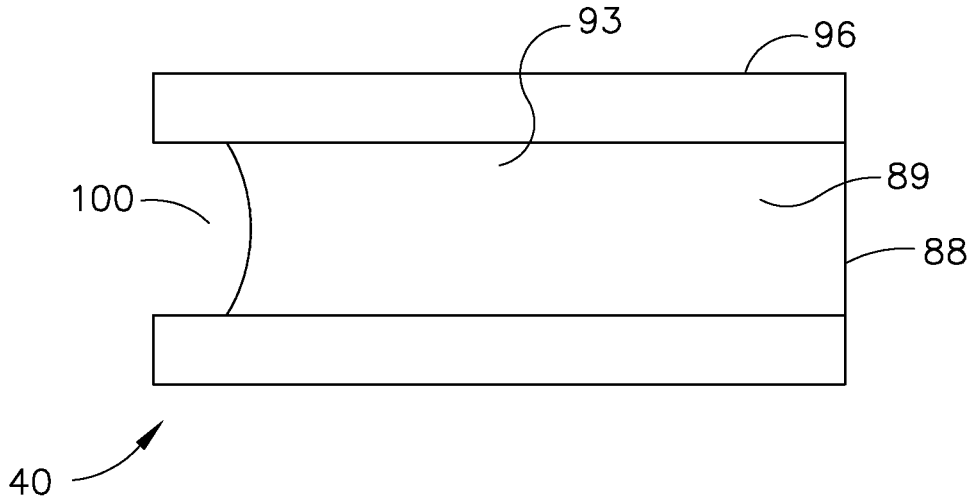
FIG. 6 is a radially inwardly looking sectional view illustration of the turbine dovetail slot heat shield illustrated in FIG. 5.
Figure 7:
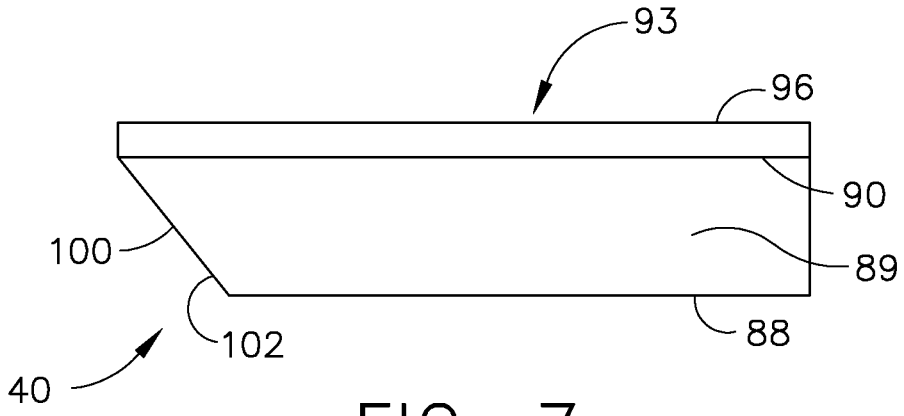
FIG. 7 is a sideways looking sectional view illustration of the turbine dovetail slot heat shield illustrated in FIG. 5.
Figure 8:
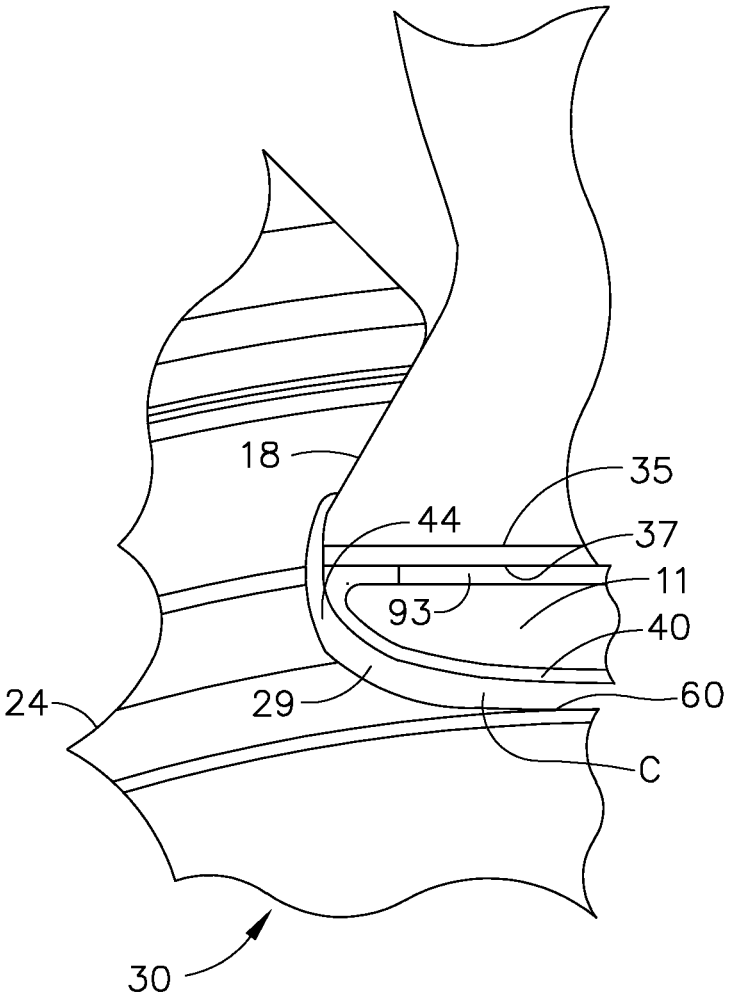
FIG. 8 is a forward looking aft sectional view illustration of a clearance between the turbine dovetail slot heat shield and the disk around the slot illustrated in FIG. 2.

Referring to FIGS. 4-7, the exemplary embodiment of the dovetail slot heat shield 40 illustrated herein has a preferably rounded body 88 including a rounded heat shield bottom 90. Sides or legs 92 extending radially outwardly or upwardly from the heat shield bottom 90. The legs may be rounded as illustrated in FIGS. 4, 5, and 8. An axially extending straight flange 96 is located along a free end 98 of each of the legs 92. The flanges 96 are attached or bonded to the bottom surface 37 of the dovetail root 18 such as by brazing. The heat shield bottom 90 may be radially spaced apart from the slot bottom 60 to help protect the slot bottom 60 from being directly exposed to the cooling air 11.

An open forward or upstream end 100 of the heat shield 40 is bevelled or slanted upstream indicated by a bevel 102 on the upstream end 100. The upstream end 100 is bevelled or slanted such that the flanges 96 and the free ends 98 of the legs 92 are longer than the heat shield bottom 90 of the heat shield 40. The bevelled or slanted upstream end 100 of the heat shield 40 helps direct the cooling air 11 into a hollow interior 89 of the body 88 of the heat shield 40. The cooling air 11 exits the hollow interior 89 through a shield outlet 93 between the flanges 96 and the free ends 98 of the legs 92 and through the plurality of inlet apertures 50. The cooling air 11 flows through the dovetail slot and through the inner root end 35 of the dovetail root 18 with minimal contact of the slot bottom 60 disposed along the rim 24 on the rotor disk 30.

Illustrated in FIG. 8 is a clearance C between at least the heat shield bottom 90 of the heat shield 40 and the slot bottom 60 to help protect the slot bottom 60 from being directly exposed to the cooling air 11. The clearance C in some embodiments of the heat shield, root, and slot may be about 0.04 inches along a substantial portion of the heat shield and slot. The body 88 including the heat shield bottom 90 and legs 92 may be rounded in order to have the body 88 closely conform to the rim 24 along the slot cooling air chamber or manifold 44 between the root end 35 of the dovetail root 18 and the slot bottom 60 of the dovetail slot 29 in the rim 24 on the disk 30.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. A gas turbine engine turbine blade assembly comprising:

a hollow airfoil integrally joined to a blade root, a dovetail slot heat shield attached to and bonded to a bottom surface of the root, the heat shield including a body with a heat shield bottom and sides or legs extending upwardly or radially outwardly from the heat shield bottom, and a shield outlet from the dovetail slot heat shield open to at least one inlet aperture extending radially through a radially inner root end of the root;

further comprising a slanted open forward or upstream end of the heat shield and free ends of the legs longer than the heat shield bottom.

2. A gas turbine engine turbine blade assembly comprising:

a hollow airfoil integrally joined to a blade root, a dovetail slot heat shield attached to and bonded to a bottom surface of the root, the heat shield including a body with a heat shield bottom and sides or legs extending upwardly or radially outwardly from the heat shield bottom, and a shield outlet from the dovetail slot heat shield open to at least one inlet aperture extending radially through a radially inner root end of the root;

further comprising an axially extending straight flange located along a free end of each of the legs and the flanges bonded to the bottom surface.

3. The assembly as claimed in claim 2 further comprising a slanted open forward or upstream end of the heat shield and the flanges and the free ends of the legs being longer than the heat shield bottom.

4. The assembly as claimed in claim 3 wherein the body is rounded.

5. The assembly as claimed in claim 4 further comprising the heat shield bottom and/or the legs are rounded.

6. A gas turbine engine turbine disk assembly comprising:

a disk including a web extending radially outwardly from a hub to a rim;

a plurality of dovetail slots in the rim;

a complimentary plurality of turbine blades removably retained in the plurality of dovetail slots;

slot bottoms of the dovetail slots and the dovetail slots extending circumferentially between disk posts in the rim on the disk, and each of the turbine blades including a hollow airfoil integrally joined to a blade root, a dovetail slot heat shield attached to a bottom surface of the root, and a shield outlet from the dovetail slot heat shield open to at least one inlet aperture extending radially through a radially inner root end of the root;

wherein each heat shield is radially spaced from the slot bottom to create a clearance C between the heat shield and the slot bottom; and the heat shield including a body with a heat shield bottom and sides or legs extending upwardly or radially outwardly from the heat shield bottom.

7. The assembly as claimed in claim 6 further comprising the heat shield being bonded to the bottom surface.

8. The assembly as claimed in claim 6 further comprising a slanted open forward or upstream end of the heat shield and free ends of the legs longer than the heat shield bottom.

9. The assembly as claimed in claim 6 further comprising:

an axially extending straight flange located along a free end of each of the legs, the flanges bonded to the bottom surface, a slanted open forward or upstream end of the heat shield, and the flanges and the free ends of the legs being longer than the heat shield bottom.

10. The assembly as claimed in claim 6 wherein the body is rounded.

11. The assembly as claimed in claim 6 further comprising the heat shield bottom and/or the legs are rounded.

* * * * *